US007398042B2

(12) United States Patent
Seo

(10) Patent No.: US 7,398,042 B2
(45) Date of Patent: Jul. 8, 2008

(54) BELT CLUTCH APPARATUS AND IMAGE FORMING APPARATUS HAVING THE SAME

(75) Inventor: Young-Wok Seo, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 334 days.

(21) Appl. No.: 11/186,822

(22) Filed: Jul. 22, 2005

(65) Prior Publication Data

US 2006/0051139 A1 Mar. 9, 2006

(30) Foreign Application Priority Data

Aug. 31, 2004 (KR) ..... 10-2004-0069050

(51) Int. Cl.
*G03G 15/01* (2006.01)

(52) U.S. Cl. ..... 399/302; 399/167; 399/308

(58) Field of Classification Search ..... 399/162, 399/164, 165, 297, 302, 308, 303, 167, 166
See application file for complete search history.

(56) References Cited

U.S. PATENT DOCUMENTS 5,565,975 A * 10/1996 Kumon et al. ..... 399/302
6,697,596 B2 * 2/2004 Bessho et al. ..... 399/302
6,931,229 B2 * 8/2005 Yoshizuka ..... 399/394
7,062,209 B2 * 6/2006 Murakami et al. ..... 399/299
7,142,799 B2 * 11/2006 Kitayama ..... 399/297
7,212,767 B2 * 5/2007 Hosokawa et al. ..... 399/111
7,239,828 B2 * 7/2007 Ito ..... 399/165

FOREIGN PATENT DOCUMENTS

| | | |
|---|---|---|
| JP | 05-072909 | 3/1993 |
| JP | 07-295394 | 11/1995 |
| KR | 10-2000-0006519 | 1/2000 |

* cited by examiner

*Primary Examiner*—Hoan H Tran
(74) *Attorney, Agent, or Firm*—Roylance, Abrams, Berdo & Goodman, L.L.P.

(57) ABSTRACT

A belt clutch apparatus for an image forming apparatus is is provided and includes a belt that rotates in contact with at least one unit, at least one movable roller for supporting the rotation of the belt, and a variable unit for changing position of the movable roller in order for the belt to have a first running path in contact with the unit and a second running path separated from the unit. Moreover, the belt can be selectively positioned in contact with a predetermined unit or separated therefrom while maintaining belt tension. Therefore, it becomes possible to protect the belt from unnecessary abrasion.

19 Claims, 7 Drawing Sheets

BELT CLUTCH APPARATUS AND IMAGE FORMING APPARATUS HAVING THE SAME

CROSS-REFERENCE TO RELATED APPLICATIONS

This application claims the benefit under 35 U.S.C. § 119 (a) from Korean Patent Application No. 2004-69050, filed on Aug. 31, 2004, the entire disclosure of which is hereby incorporated by reference.

BACKGROUND OF THE INVENTION

1. Field of the Invention

The present invention relates to a belt apparatus. More specifically, the present invention relates to a belt clutch apparatus, an intermediate transfer belt with the clutch, and an image forming apparatus with the intermediate transfer belt.

2. Description of the Related Art

In general, the operation range of a belt apparatus is determined by a plurality of rollers rotatably installed therein. The belt apparatus serves a wide range of applications such as supplying power to other units that are separated by a predetermined distance or carrying substances during rotation. Generally, in an image forming apparatus for printing color images, the belt is positioned between a developing unit and a printing paper for carrying developer. Particularly, the belt apparatus typically used is called an intermediate transfer belt. FIG. 1 is a schematic view of the color image forming apparatus, which includes a plurality of photosensitive drums for each color, and an intermediate transfer belt for transferring visible images from the photosensitive drums.

As shown in FIG. 1, the color image forming apparatus 1 includes a paper feeding unit 10, a carriage unit 20, a developing unit 30, an intermediate transfer belt 40, a fusing unit 50, and a delivery unit 60.

The paper feeding unit 10 picks up a piece of paper being received, and feeds (or supplies) the paper to the carriage unit 20.

The carriage unit 20 carries the paper to the intermediate transfer belt 40.

The developing unit 30 includes (as shown, e.g., in FIG. 1) four developing cartridges, each having a developing roller and a photosensitive medium, e.g., a photosensitive drum (e.g., 32C, 32M, 32Y, and 32B), so that cyan, magenta, yellow and black developers can be developed individually on the four respectively corresponding photosensitive mediums. When the photosensitive mediums with a visible image formed thereon according to colors are brought in contact with the intermediate transfer belt 40, they rotate and are layered sequentially on the surface of the intermediate transfer belt 40 to form a color image.

The intermediate transfer belt 40 includes a plurality of rollers configured for driving. Usually, the intermediate transfer belt 40 rotates with a backup roller 41, and transfers a color image transmitted from the developing unit 30 onto the printing paper being carried by the carriage unit 20.

The fusing unit 50 applies high temperature and high pressure to the printing paper bearing the visible image in order to fuse the transferred image onto the printing paper.

The delivery unit 60 delivers the printing paper with the color fused image thereon out of the image forming apparatus.

However, because the intermediate transfer belt 40 always rotates in contact with the developing unit 30 and the backup roller 41, it may easily wear out or abrade as the duration of use increases. Therefore, to extend lifespan of the intermediate transfer belt 40, it generally is best to minimize contact time with the developing unit 30 and the backup roller 41 for reducing abrasion as much as possible.

In practice, however, the operation range of the intermediate transfer belt 40 is fixed by a plurality of roller members. Once the operation range is set, it typically cannot be changed. Therefore, even during the cleaning operation, where there is no need for the intermediate transfer belt 40 to be in contact with the developing unit 30 and/or the backup roller 41, the intermediate transfer belt 40 is constantly driven in contact with the developing unit 30 and the backup roller 41.

Accordingly, there is a need for an improved image forming apparatus having which does not unnecessarily abrade the intermediate transfer belt 40.

SUMMARY OF THE INVENTION

An aspect of the present invention is to solve at least the above problems and/or disadvantages and to provide at least the advantages described below. Accordingly, an aspect of the present invention is to provide a belt clutch apparatus in which the belt may be selectively positioned in contact with a predetermined unit or separated therefrom while maintaining belt tension, and an image forming apparatus having the same.

To achieve the above aspect and advantages, there is provided a belt clutch apparatus having a belt for rotating in contact with at least one unit, at least one movable roller for supporting the rotation of the belt, and a variable unit for changing positions of the movable roller in order for the belt to have a first running path in contact with the unit and a second running path separated from the at least one unit.

According to an exemplary embodiment of the present invention, the variable unit may include a swing plate for supporting the rotation of the movable roller; and a pivot for rotating the swing plate.

Preferably, two movable rollers are arranged on the swing plate.

According to an exemplary embodiment of the present invention, the belt may be selectively positioned in contact with a predetermined unit or separated therefrom while maintaining belt tension. Therefore, it becomes possible to protect the belt from unnecessary abrasion.

Another aspect of the present invention provides an intermediate transfer belt clutch apparatus for use in an image forming apparatus, the intermediate transfer belt clutch apparatus includes an intermediate transfer belt for rotating in contact with a developing unit and a transfer backup roller, at least one movable roller for supporting the rotation of the intermediate transfer belt, and a variable unit for changing positions of the movable roller in order for the intermediate transfer belt to have a first running path in contact with the transfer backup roller and a second running path separated from the transfer backup roller.

According to an exemplary embodiment of the present invention, the variable unit includes a swing plate for supporting the rotation of the movable roller and a pivot for rotating the swing plate.

Preferably, two movable rollers are arranged on the swing plate.

Another aspect of an exemplary embodiment of the present invention provides an image forming apparatus, including an intermediate transfer belt for rotating in contact with a developing unit and a transfer backup roller, at least one movable roller for supporting the rotation of the intermediate transfer belt, and a variable unit for supporting the rotation of the movable roller to change positions of the movable roller in order for the intermediate transfer belt to have a first running path in contact with the transfer backup roller and a second running path separated from the transfer backup roller.

According to an exemplary embodiment of the present invention, the variable unit includes a swing plate for supporting the rotation of the movable roller and a pivot for rotating the swing plate.

Preferably, the variable unit is arranged on the inward side of the intermediate transfer belt in contact with the transfer backup roller, or the inward side of the intermediate transfer belt in contact with the developing unit, or both.

As such, by applying the belt clutch to the intermediate transfer belt in the image forming apparatus, the intermediate transfer belt can be selectively positioned in contact with or separated from the relevant developing unit and/or the transfer backup roller. As a result, the possibility of abrasion of the intermediate transfer belt due to contact may be reduced markedly.

Other objects, advantages, and salient features of the invention will become apparent to those skilled in the art from the following detailed description, which, taken in conjunction with the annexed drawings, discloses exemplary embodiments of the invention.

BRIEF DESCRIPTION OF THE DRAWINGS

The above and other objects, and features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF THE EXEMPLARY EMBODIMENT

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
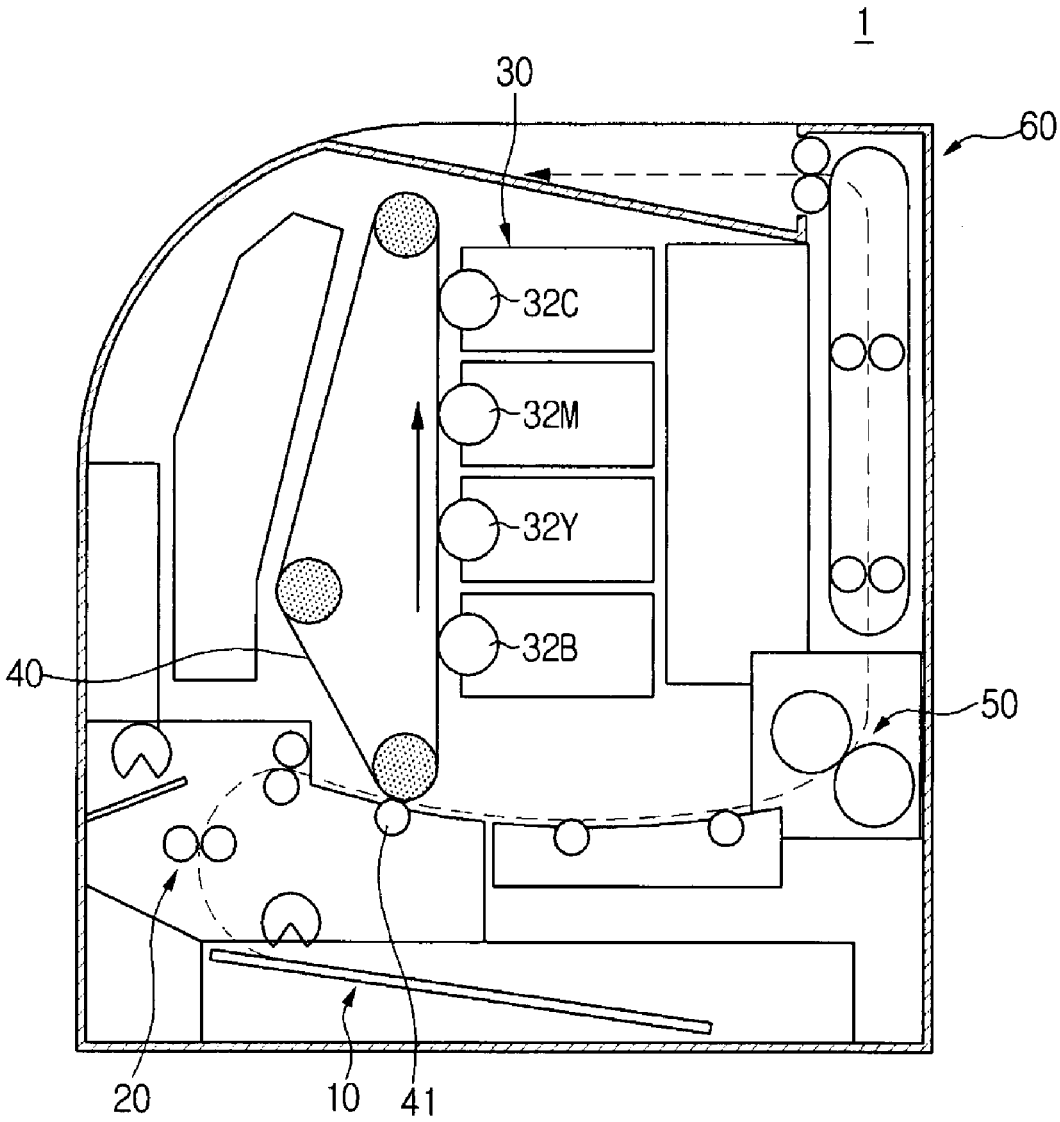
FIG. 1 (PRIOR ART)
FIG. 1 is a schematic view of an image forming apparatus having a conventional intermediate transfer belt.
Figure 2:
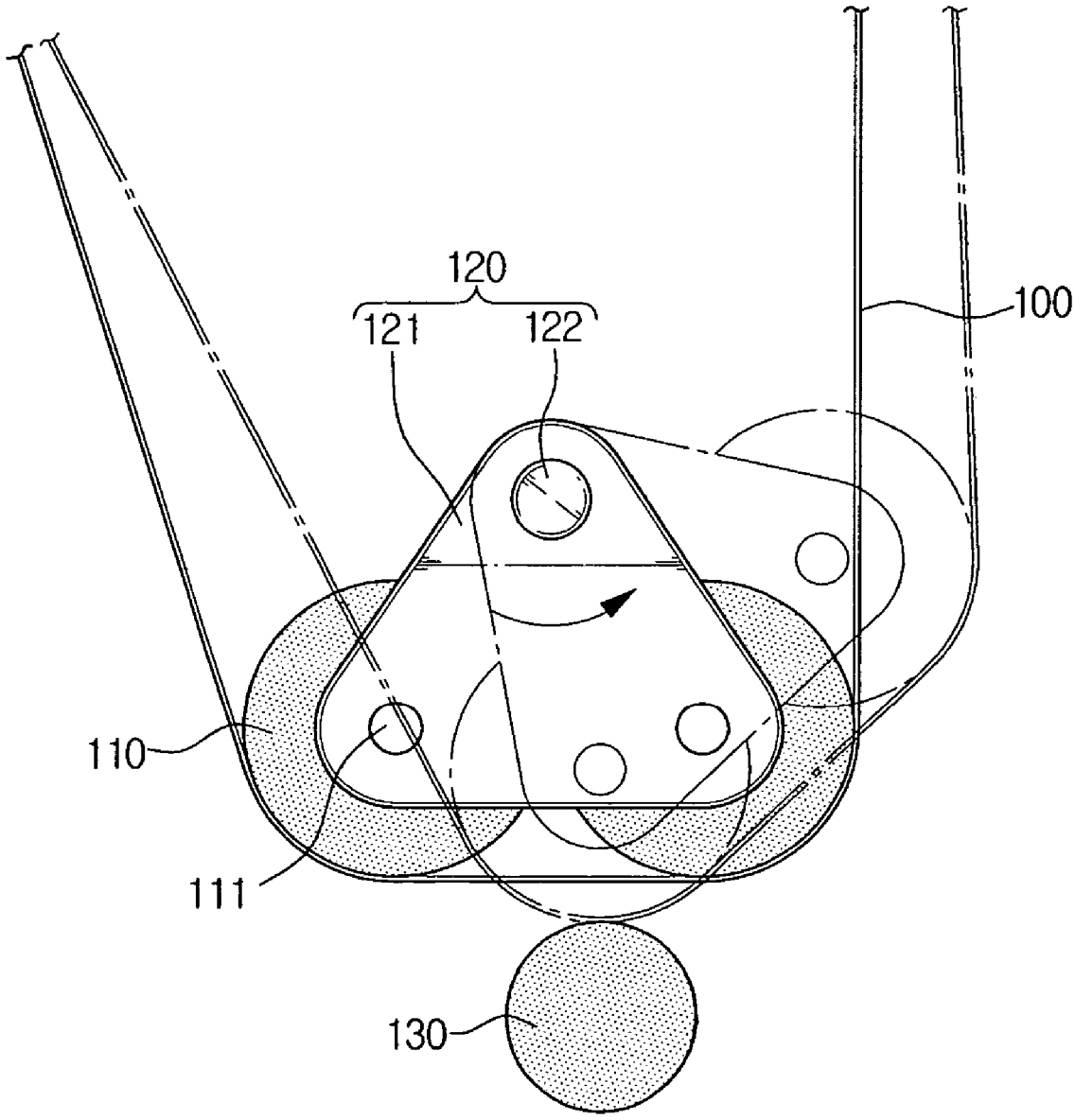
FIG. 2 is a schematic view of a belt clutch apparatus in accordance with an embodiment of the present invention, and an operated condition thereof.
Figure 3:
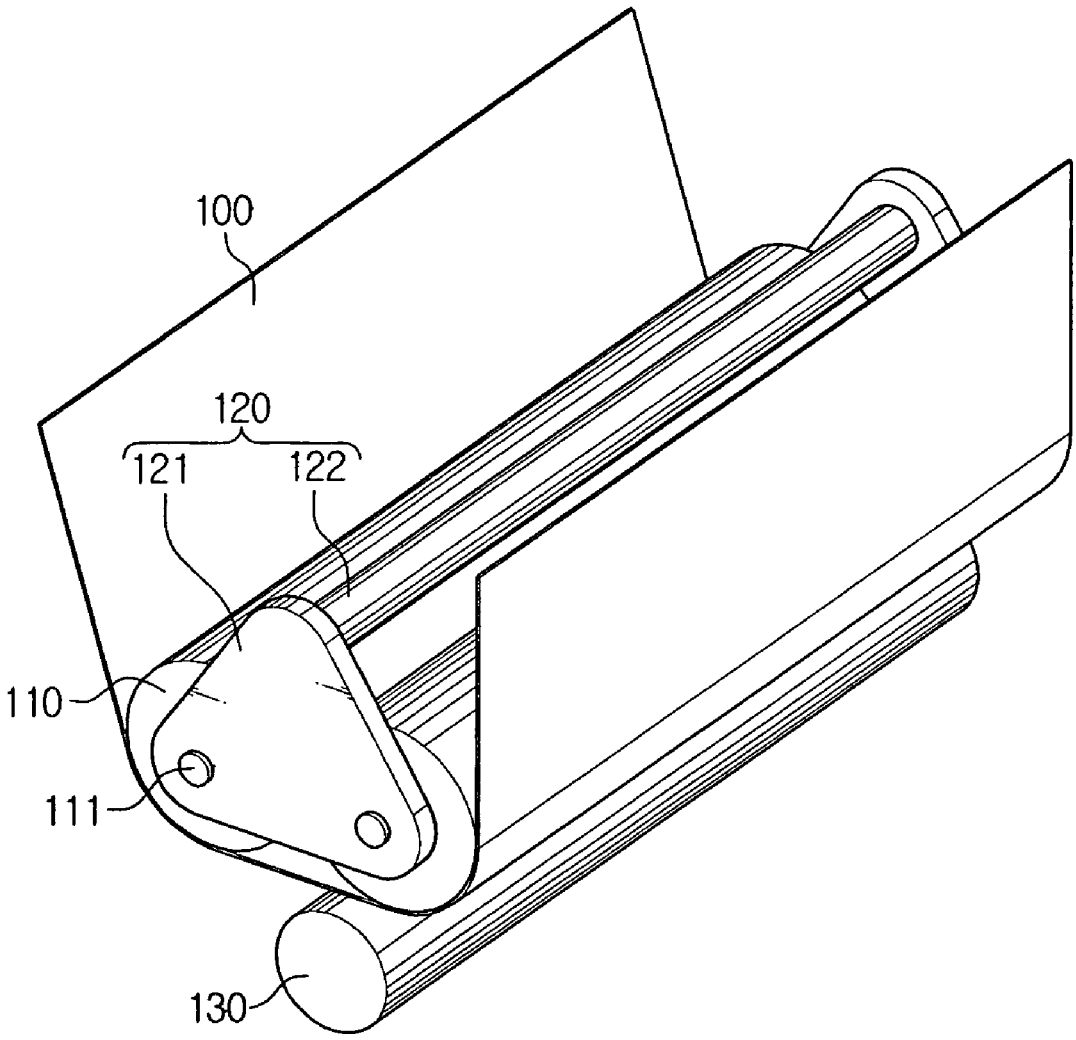
FIG. 3 is a perspective view of the intermediate transfer belt of FIG. 2 in the separated position.
Figure 4:
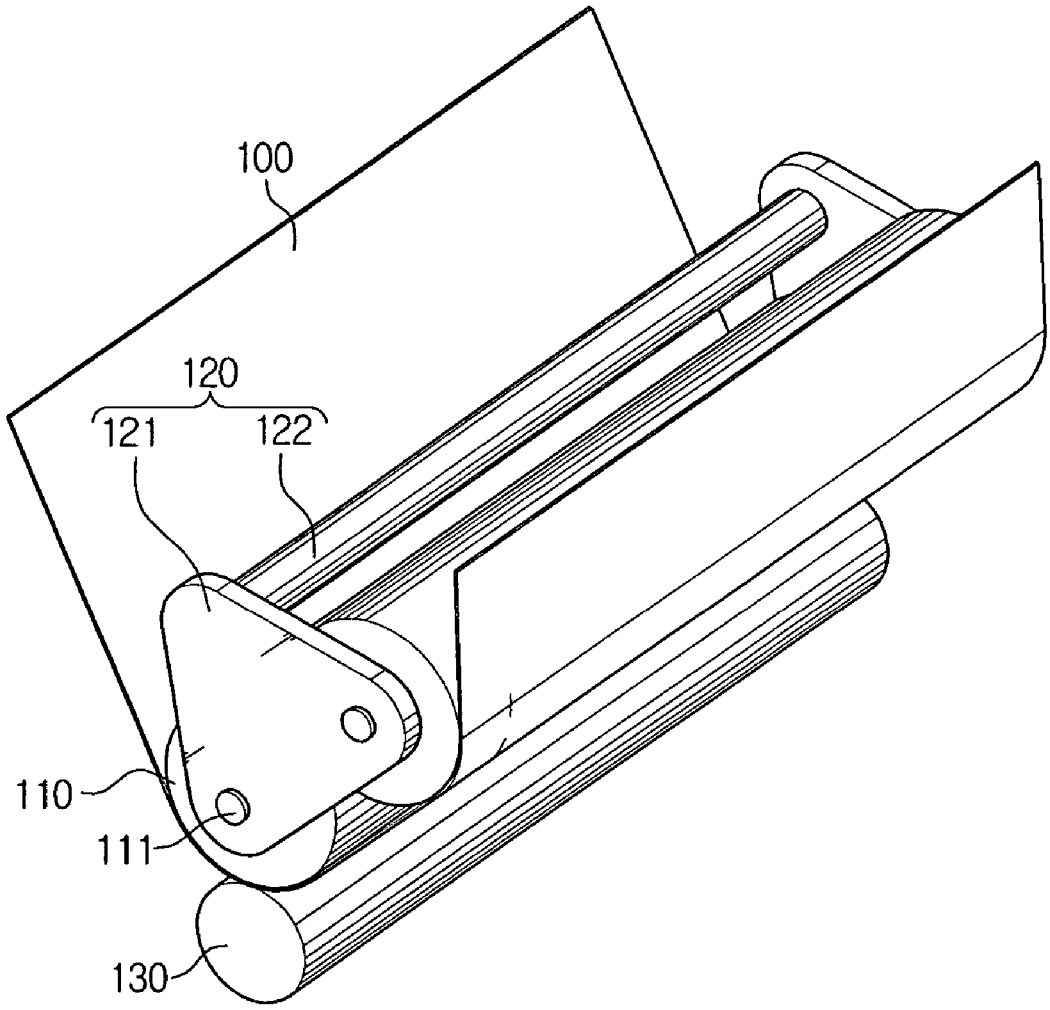
FIG. 4 is a perspective view of the intermediate transfer belt of FIG. 2 in the contact position.

Referring to FIGS. 2-4, a belt clutch apparatus in accordance with an embodiment of the present invention includes a belt 100, a movable roller 110, and a variable unit 120.

The belt 100 is preferably rotatably supported by a plurality of rollers (not shown), and at least one of the rollers is in contact with the belt 100. FIG. 3 illustrates a case where the belt 100 rotates and is separated from a predetermined unit 130. FIG. 4 illustrates a case where the belt 100 rotates and is in contact with the unit 130.

The movable roller 110 supports the rotation of the belt 100, and is arranged so that a position of a roller shaft 111 may be varied. Preferably, there are two movable rollers 110 arranged on the inward side of the belt 100 that is in contact with the unit 130.

The variable unit 120 includes a swing plate 121 and a pivot 122. The variable unit 120 supports the rotation of the movable roller 110. The variable unit 120 changes position of the roller shaft 111 so that the belt has two running paths. For example, the first running path in contact with the unit 130 and the second running path is separated from the unit 130.

The swing plate 121 enables both ends of the movable roller 110 to rotate. Preferably, as shown in FIG. 2, the roller shaft 111 of each movable roller 110 is rotatably arranged on the swing plate 121.

The pivot 122 supported on the swing plate 121 enables the movable rollers 110 arranged on the swing plate 121 to support the belt 100. If the pivot 122 rotates in the direction of the arrow shown in FIG. 2, the swing plate 121 and the movable rollers 110 rotate together and change the track of the belt 100. At this time, the tension of the belt 100 is maintained uniformly throughout rotation.

The belt clutch apparatus with the above structure can be applied to the intermediate transfer belt of the image forming apparatus. In that case, the belt 100 corresponds to the intermediate transfer belt, and the unit 130 corresponds to a transfer backup roller rotating in contact with the belt 100. Hereinafter, reference numeral 100 will denote the intermediate transfer belt, and reference numeral 130 will denote the transfer backup roller.

Figure 5:
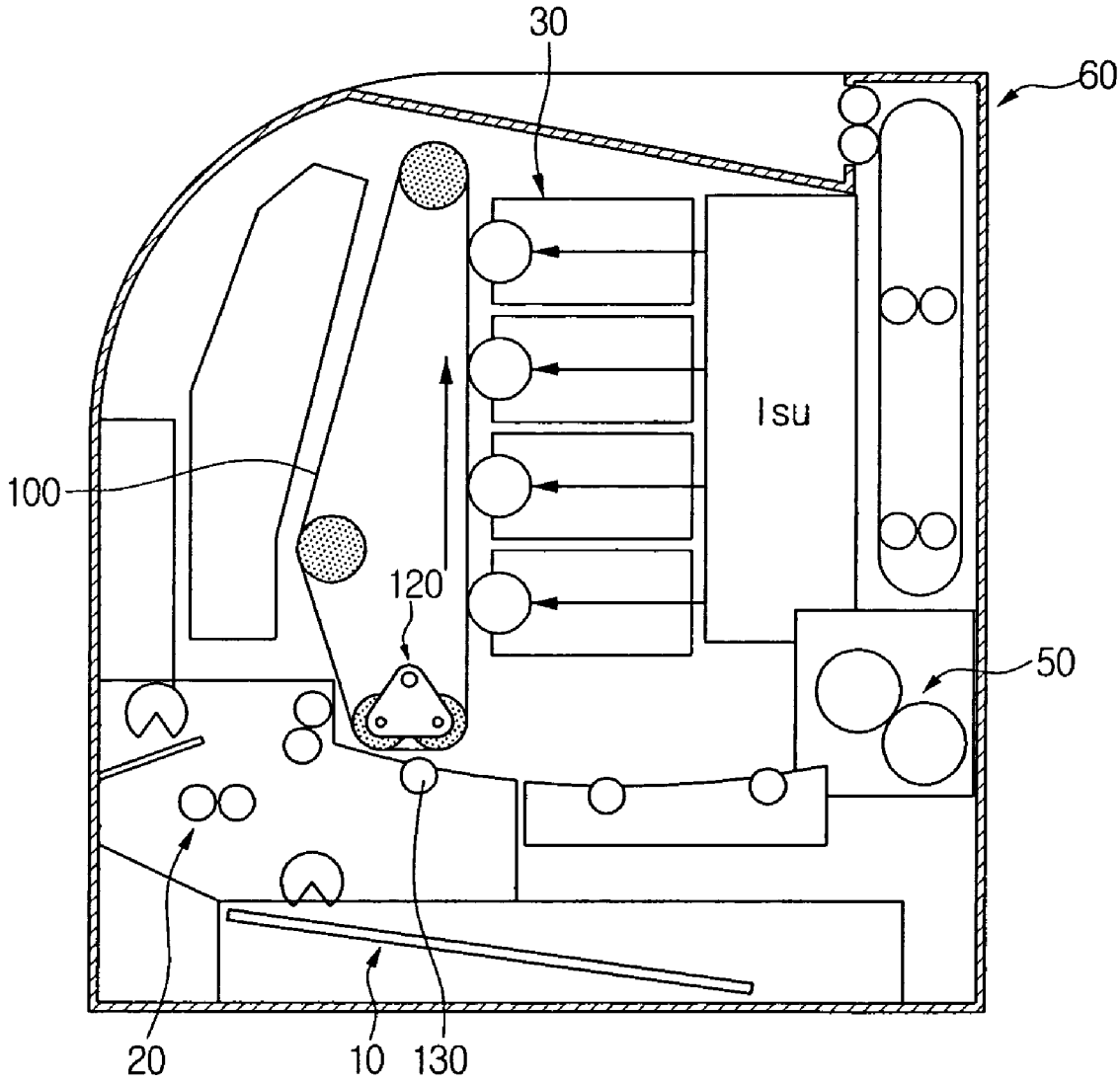
FIGS. 5-7 are schematic views of an image forming apparatus having the intermediate transfer belt of FIG. 2.

Referring now to FIG. 5, an image forming apparatus includes a paper feeding unit 10, a carriage unit 20, a developing unit 30, an intermediate transfer belt 100, a fusing unit 50, and a delivery unit 60. Because the structures and functions of the components (except for the intermediate transfer belt and the variable unit) in the image forming apparatus of exemplary embodiments of the present invention are the same as those in a related art color image forming apparatus, a detailed description of the functions and constructions thereof will be omitted for purposes of clarity and conciseness. Therefore, the following description will focus more on the intermediate transfer belt 100 and the variable unit 120 adjusting the track of the intermediate transfer belt 100.

The intermediate transfer belt 100 rotates in contact with the transfer backup roller 130 to transfer an image developed by the developing unit 30 onto printing paper. That is, the intermediate transfer belt 100 is rotatably supported by a plurality rollers along a predetermined track. More particularly a movable roller 110 having a variable roller shaft supports the inward side of the intermediate transfer belt 100 in contact with the transfer backup roller 130.

The variable unit 120 includes a swing plate 121 and a pivot 122. The variable unit 120 supports the rotation of the movable roller 110, and changes position of the roller shaft 111 so that the intermediate transfer belt 100 has two running paths. As stated above, the first running path is in contact with the transfer backup roller 130 and the second running path is separated from the transfer backup roller 130.

Therefore, in a warming up mode or cleaning mode, where the paper does not pass through the printing path, the movable roller 110, as shown in FIG. 5, supports the intermediate transfer belt 100 and the intermediate transfer belt 100 rotates along the second running path. In a printing mode, on the other hand, the movable roller 110 supports the intermediate transfer belt 100 and the intermediate transfer belt 100 rotates along the first running path.

Figure 6:
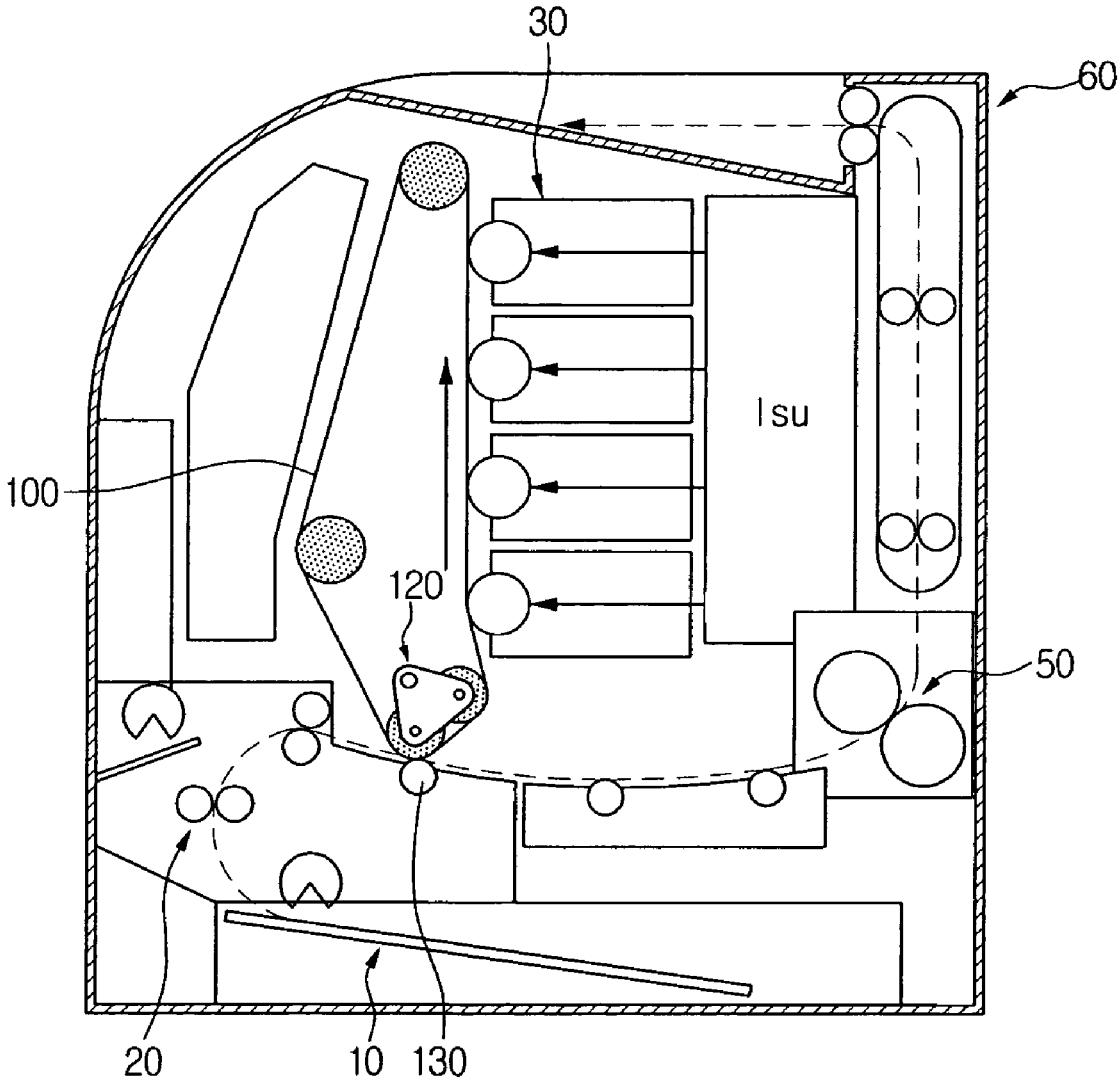
Figure 7:
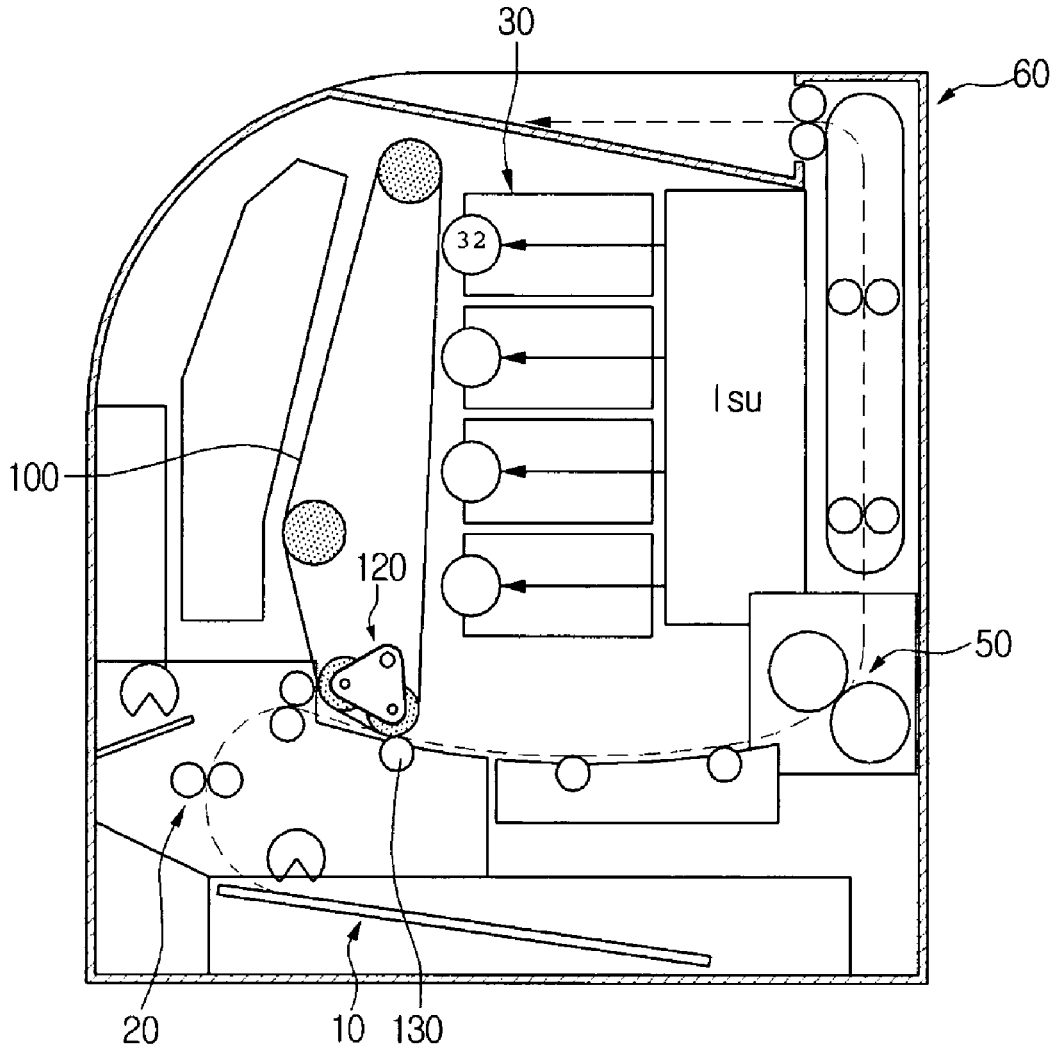

As shown in FIG. 7, the movable roller 110 and the variable unit 120 can also be applied to the intermediate transfer belt 100 in contact with a photosensitive medium 32. As illustrated in FIGS. 5-7 the image forming apparatus includes a plurality of developing units (e.g., developing cartridges) developing at least four different colors individually. The movable roller 110 and the variable unit 120 may be arranged on the inward side of the intermediate transfer belt 100 in contact with a photosensitive medium 32 (e.g., 32C, 32M, 32Y, and 32W corresponding to each color. In that case, for color printing, it is possible to operate the variable unit 120 so that only the developing unit of a relevant color is in contact with the intermediate transfer belt 100.

Through the rotation of the variable unit 120, the intermediate transfer belt 100 can be positioned in contact with or separated from the transfer backup roller 130 and/or the relevant developing unit. Therefore, in the warming up mode or the cleaning mode, where the paper does not pass through the printing path, the intermediate transfer belt 100 separates from the transfer backup roller 130. Also, if only part of the colors are needed for developing an image, photosensitive media of colors irrelevant to the image formation can be separated from the intermediate transfer belt 100. In this manner, it becomes possible to prevent unnecessary abrasion of the intermediate transfer belt 100.

As such, in accordance with an exemplary embodiment of the present invention, the belt can be selectively positioned in contact with a predetermined unit or separated therefrom while maintaining belt tension. Therefore, it is possible to protect the belt from unnecessary abrasion.

Moreover, by applying the belt clutch to the intermediate transfer belt in the image forming apparatus, the intermediate transfer belt can be selectively positioned in contact with or separated from the relevant photosensitive medium and/or the transfer backup roller. As a result, the possibility of abrasion of the intermediate transfer belt due to the contact can be reduced markedly.

While the invention has been shown and described with reference to certain embodiments thereof, it will be understood by those skilled in the art that various changes in form and details may be made therein without departing from the spirit and scope of the invention as defined by the appended claims.

What is claimed is:

1. A belt clutch apparatus, comprising:

a belt for rotating in contact with at least one unit;

at least one movable roller for supporting the rotation of the belt; and a variable unit for changing positions of the movable roller in order for the belt to have a first running path in contact with the at least one unit and a second running path separated from the at least one unit, wherein the variable unit comprises:

a swing plate for supporting the rotation of the movable roller; and a pivot for rotating the swing plate; and two movable rollers are arranged on the swing plate.

2. An intermediate transfer belt clutch apparatus, comprising:

an intermediate transfer belt for rotating in contact with a photosensitive medium and a transfer backup roller;

at least one movable roller for supporting the rotation of the intermediate transfer belt; and a variable unit for changing positions of the movable roller in order for the intermediate transfer belt to have a first running path in contact with the transfer backup roller and a second running path separated from the transfer backup roller.

3. The intermediate transfer belt clutch apparatus according to claim 2, wherein the variable unit comprises:

a swing plate for supporting the rotation of the movable roller; and a pivot for rotating the swing plate.

4. The intermediate transfer belt clutch apparatus according to claim 3, wherein two movable rollers are arranged on the swing plate.

5. The intermediate transfer belt clutch apparatus according to claim 4, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

6. The intermediate transfer belt clutch apparatus according to claim 3, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

7. The intermediate transfer belt clutch apparatus according to claim 2, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

8. An image forming apparatus, comprising:

an intermediate transfer belt for rotating in contact with a photosensitive medium and a transfer backup roller, the intermediate transfer belt being configured to transfer an image onto printing paper;

at least one movable roller for supporting the rotation of the intermediate transfer belt; and a variable unit for changing positions of the movable roller in order for the intermediate transfer belt to have a first running path in contact with the transfer backup roller and a second running path separated from the transfer backup roller.

9. The image forming apparatus according to claim 8, wherein the variable unit comprises:

a swing plate for supporting the rotation of the movable roller; and a pivot for rotating the swing plate.

10. The image forming apparatus according to claim 9, wherein two movable rollers are arranged on the swing plate.

11. The image forming apparatus according to claim 10, wherein the variable unit is arranged on the inward side of the intermediate transfer belt in contact with the transfer backup roller.

12. The image forming apparatus according to claim 10, further comprising an additional variable unit including at least one additional movable roller, wherein the additional variable unit is arranged on an inward side of the intermediate transfer belt to selectively contact the intermediate transfer belt with the photosensitive medium.

13. The image forming apparatus according to claim 10, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

14. The image forming apparatus according to claim 9, wherein the variable unit is arranged on the inward side of the intermediate transfer belt in contact with the transfer backup roller.

15. The image forming apparatus according to claim 9, further comprising an additional variable unit including at least one additional movable roller, wherein the additional variable unit is arranged on an inward side of the intermediate transfer belt to selectively contact the intermediate transfer belt with the photosensitive medium.

16. The image forming apparatus according to claim 9, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

17. The image forming apparatus according to claim 8, wherein the variable unit is arranged on the inward side of the intermediate transfer belt in contact with the transfer backup roller.

18. The image forming apparatus according to claim 8, further comprising an additional variable unit including at least one additional movable roller, wherein the additional variable unit is arranged on an inward side of the intermediate transfer belt to selectively contact the intermediate transfer belt with the photosensitive medium.

19. The image forming apparatus according to claim 8, further comprising an additional variable unit including at least one additional movable roller, wherein the variable unit is arranged on an inward side of the intermediate transfer belt to selectively contact the intermediate transfer belt with the transfer backup roller, and the additional variable unit is arranged on the inward side of the intermediate transfer belt to selectively contact the intermediate transfer belt with the photosensitive medium.

* * * * *